US005894116A

United States Patent [19]

Da Dalt

[11] Patent Number: 5,894,116

[45] Date of Patent: Apr. 13, 1999

[54] SAFETY SWITCH WITH ROTATABLE HEAD

[75] Inventor: Hugues Da Dalt, L'Isle D'Espagnac, France

[73] Assignee: Schneider Electric SA, Boulogne-Billancourt, France

[21] Appl. No.: 08/962,770

[22] Filed: Nov. 3, 1997

[30] Foreign Application Priority Data

Nov. 4, 1996 [FR] France ..... 96 13627

[51] Int. Cl.[6] ..... H01H 27/00

[52] U.S. Cl. ..... 200/43.04; 200/334

[58] Field of Search ..... 200/332.1, 334, 200/43.04, 43.07, 47

[56] References Cited

U.S. PATENT DOCUMENTS 4,963,706 10/1990 Mohtasham ..... 200/334

5,488,207 1/1996 Niwa et al. ..... 200/43.04

FOREIGN PATENT DOCUMENTS 37 10 079 A1 10/1988 Germany .

39 43 377 C1 2/1991 Germany ..... H01H 9/02

42 38 016 A1 5/1994 Germany .

*Primary Examiner*—Michael L. Gellner

*Assistant Examiner*—Lee S. Lum

*Attorney, Agent, or Firm*—Oblon, Spivak, McClelland, Maier & Neustadt, P.C.

[57] ABSTRACT

A safety switch including a control head rotatably linked to a casing that encloses an electrical contact assembly. A cylindrical collar of the head, engaged in an opening in the casing, is equipped with an annular groove with which retaining elements cooperate in order to immobilize the head along a predetermined direction. A fixing screw cooperates with re-entrant elements situated on the periphery of the collar in order to lock the head and prevent the head from rotating.

5 Claims, 4 Drawing Sheets

SAFETY SWITCH WITH ROTATABLE HEAD

BACKGROUND OF THE INVENTION

1. Field of the Invention

This invention relates to a safety switch of the type that includes a casing housing electrical contact devices and a control head fixed to the casing, this head being able to take up several positions displaced from one another by rotation of for example 90° about an axis oriented along a main direction, and including a safety mechanism with a turning wheel and a push rod to operate the contact devices and at least one slot for an external actuator to pass there through, the actuator being capable of operating the safety mechanism.

2. Discussion of the Background

Safety switches of this type are known. Their control head generally includes a control wheel which is able to be turned about an axis perpendicular to the main direction in order to act on the push rod. It is useful to be able to choose the position of the control head by rotation about the main direction so as to adapt to local mounting conditions for the safety switch.

To this end, it is already known to use safety switches, the control head of which, fixed to the casing by screws, can pass from a first position to a second position through the following actions: unscrewing the screws so as to release the head from its first position, lifting the head in the main direction, rotating the head into the second position, then tightening up the screws in order to ensure the head is locked in this new position. From the point of view of the operator, it would be desirable to simplify the method of changing the position of the control head.

In addition, untimely loosening of the screws fixing the head to the casing risks causing a change in the state of the electrical contact devices. In effect, since these are being operated by the push rod along the main direction, the push rod being part of the head, they risk being no longer secured in this direction. It is important therefore to ensure that the head is reliably locked along the main direction.

SUMMARY OF THE INVENTION

The aim of the invention is to simplify the operation and the means of changing the position of the control head by rotation, in a safety switch of the type described, as well as to immobilize the head in translation with respect to the casing.

According to the invention, the control head comprises:

- a lower part with a cylindrical collar engaged in an opening in an upper wall of the casing, having a central guide passage for the push rod, the collar being fitted, on the one hand with an annular groove and on the other hand with re-entrant elements distributed at regular intervals on its periphery,
- retaining elements engaged perpendicular to the main direction in a side opening in the casing and in the annular groove, to prevent translation of the head along the main direction,
- a screw for fixing the head in rotation, this screw extending, preferably perpendicular to the main direction and co-operating with one or the other of the re-entrant elements in order to block rotation of the head.

The fixing screw may preferably be used to fix a cover to the casing closing the compartment where the contact assembly is housed. It may, on the other hand, be advantageous to fit the retaining elements onto at least one forked shaped component and to provide, between the control head and the casing, at least one resilient indexing element movable in the main direction in order to facilitate the indexing of the head in its chosen position.

BRIEF DESCRIPTION OF THE DRAWINGS

The description that will now be made of an embodiment example of the safety switch conforming to the invention, making reference to the appended drawings, will allow the structure and characteristics of this safety switch to be well understood.

DESCRIPTION OF PREFERRED EMBODIMENTS

Figure 1:
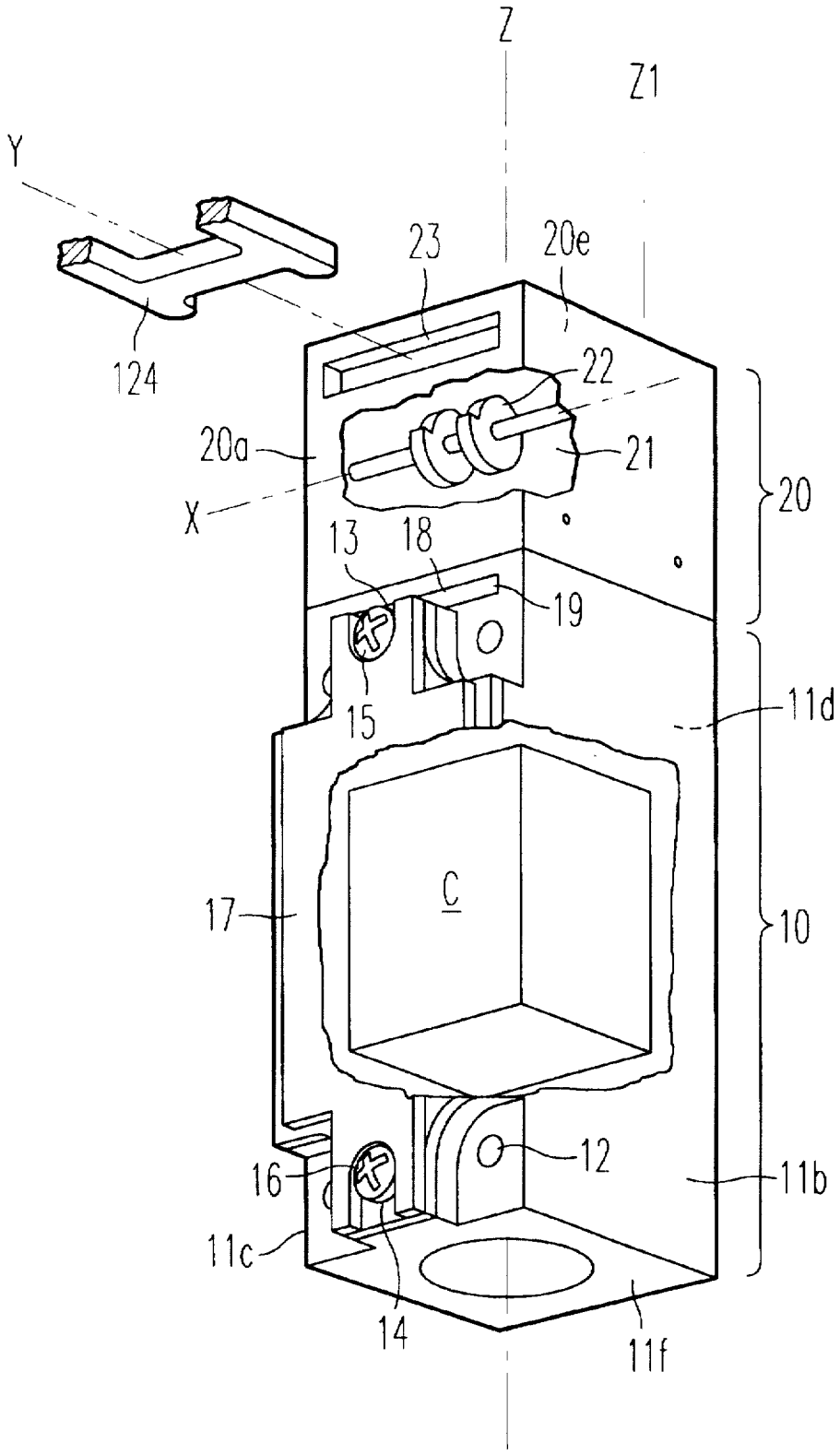
FIG. 1 diagrammatically represents a safety switch according to the invention.
Figure 2:
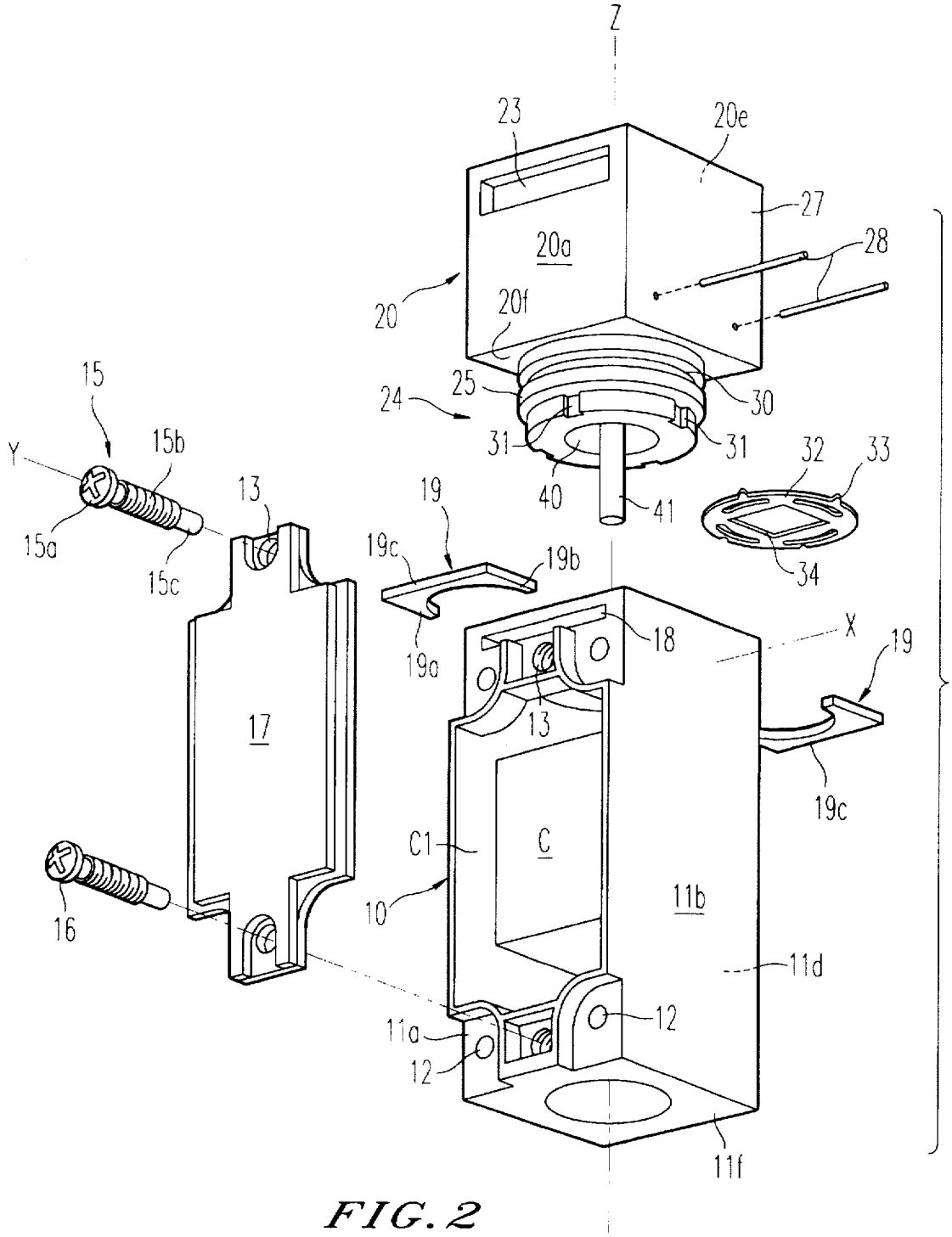
FIG. 2 shows, in perspective from below and to a larger scale, an exploded view of the switch.
Figure 3:
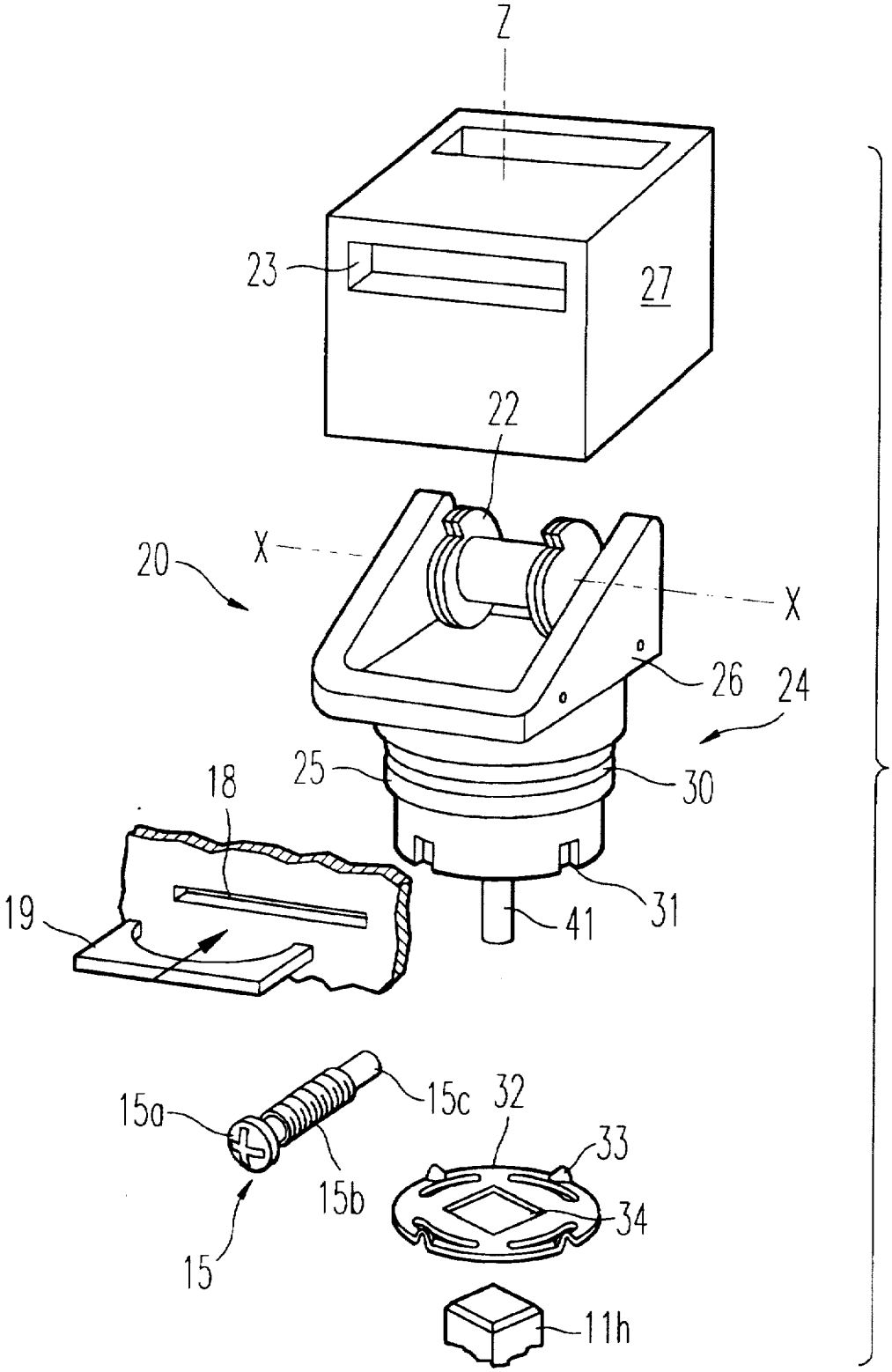
FIG. 3 shows, in exploded perspective from above, the control head, with its cover removed, with the corresponding parts from the front face of the casing.

The safety switch illustrated in FIG. 1 includes, on the one hand, a casing 10 in the shape of a parallelepiped, elongated along an axis Z, parallel to a main direction Z1 and on the other hand, an approximately cubic control head 20, fixed to the casing in such a way that it can take up several positions, angularly differentiated by rotation about axis Z.

The casing 10 has side faces 11*a*–11*d* and an upper face 11*e* adjacent the head 20 and a lower face 11*f* fitted with a feedthrough for the conductors. The front side face 11*a*, has holes 12 for the passage of screws to fix the switch to a back support which is not shown and one or two tapped holes 13, 14 for the passage of screws, respectively 15, 16 for fixing a detachable cover 17. A contact assembly C is arranged in a compartment C1 of the casing capable of being closed by the cover 17. On each of its front 11*a* and rear 11*d* side faces, the casing includes at least one opening, for example a slot 18 for the passage of a pin or a stirrup 19 to ensure that the head 20 is locked in translation. The opening may only be provided on one side face of the casing.

The control head 20 houses a safety mechanism 21 that includes at least one control wheel 22 rotatably mounted about an axis X perpendicular to Z1, and elements, not shown for locking this wheel, and a push rod with an axis parallel to Z1, for example coincident with Z, the push rod being fixed to the wheel and intended to actuate the mechanical contacts of the assembly C. The head 20 has, on one of its side faces 20*a*, here positioned forward, a guide slot 23 for a safety actuator 124 of a particular shape that permits, notably during its insertion movement, the locking elements to be unlocked before the wheel 22 is turned. The actuator 124 is, for example, connected to an enclosure gate for electrical equipment or to a machine gate and is displaced approximately along a direction Y perpendicular to X and Z. Another slot may be provided for passage of the actuator 124 in the upper wall 20*e* of the head.

The control head 20 has a lower part 24 with a cylindrical collar 25 and an upper part 26. The upper part 26 serves as a support for the safety mechanism 21, in particular for the wheels 22, and is covered by a hood 27 provided with guide slots 23 for the actuator. The hood 27 is fixed to the support 26 of the mechanism by means of pins 28 or analogous elements accessible outside of the casing. The collar 25 goes into a circular opening 11*g* in the wall 11*e* of the casing and includes from the top to the bottom an annular groove 30 and a group of re-entrant elements, for example in the form of four notches 31, distributed on its periphery offset at 90° to one another.

In order to co-operate with the annular groove 30, one or two stirrups 19 are provided, each going into a slot 18 in a side wall of the casing, in such a way that the side branches 19*a*, 19*b* of the stirrup go into the groove so as to immobilize the head with respect to the casing in the direction Z1 and that the core 19*c* of the stirrup closes up the slot 18 vis-à-vis the outside. On the other hand, in order to co-operate with each notch 31, on the end of the upper screw 15 opposite its head 15*a*, beyond its threaded part 15*b*, a non-threaded locking finger 15*c* is provided; the finger 15*c* is intended to go into the notch at the end of the screw travel in order to prevent the head from turning about the axis Z. It should be noted that the screw 15 passes into an opening 17*a* in the cover 17 to jointly ensure the immobilization in rotation of the control head and the fixing of the cover to which the screw 16 also contributes.

The head 20 has a central passage 40 for the push rod 41 which extends along the axis Z and transmits to the contact assembly C, the movement communicated by the mechanism 21. It is understood that, in a variant where the screw 15 does not participate in the fixing of the cover, it can be linked to a wall 11*b*–11*d* of the casing other than wall 11*a*.

Between the lower face of the lower part 24 of the head and the bottom of the casing, a washer 32 is provided that carries four resilient indexing elements 33 distributed on its periphery and a central square shaped orifice 34; the washer is immobilized in rotation at the bottom of the opening 11*g* by its central orifice engaging with a square boss 11*h* on the bottom. The elements act resiliently in the direction Z1 and can go into the open lower end of the notches 31. This allows, on the one hand, pre-indexing of the control head 20 in the chosen rotational position, while waiting for its immobilization in rotation by the screw 15. On the other hand, it facilitates the positioning of the head when one is passing from one position to another.

Figure 4:
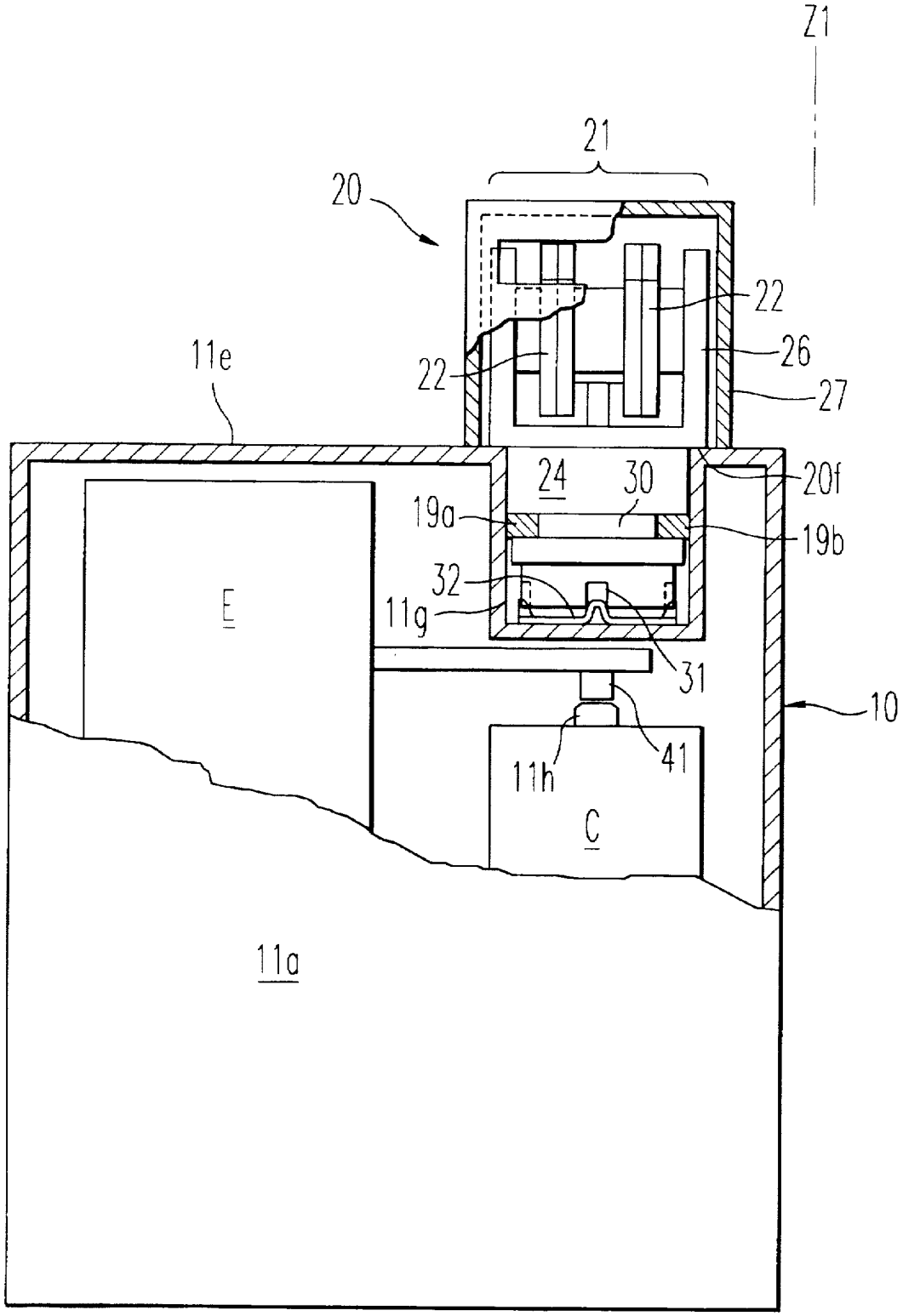
FIG. 4 is an elevational view and partial section of a second embodiment of the switch with an electromagnet.

A version of the safety switch according to the invention with an electromagnet is represented in FIG. 4. The head is still engaged in the opening 11*g* in the upper face of the casing, then held in translation by the engagement of the stirrup or the two stirrups 19 in the annular groove 30 and is held in rotation by co-operation of the screw 15 with a notch 31.

The device described operates in the following manner. To pass from one position of the head to another, the screw 15 is unscrewed in order to disengage the finger 15*c* from the respective notch 31. The head can then be turned through the angle desired, equal to 90° or a multiple of 90°, the head collapsing the indexing elements along Z1 until the elements 33 go into the notches 31. The head is locked into its new position by tightening up the screw 15, the finger of which 15*c* engages with a new notch 31 facing where it was introduced. It may be observed that the head 20 changes positions without it having been necessary to remove it and by a simple operation of a screw 15, its lower face 20*f* constantly remaining on the upper face 11*e* of the casing. The head 20 is furthermore easily disassembled by operation of the screw 15 and of the stirrup or the two stirrups 19.

I claim:

1. A safety switch including a casing on which a control head is mounted in a main direction and housing an electrical contact assembly, the control head comprising:

a control mechanism with a control wheel capable of turning in order to control the contact assembly via a push rod extending along an axis parallel to the main direction, at least one slot for the passage of an external actuator intended to cooperate with the wheel in order to turn the wheel, the control head being mounted in the casing so as to be rotatable about an axis parallel to the main direction, the control head having a lower part with a cylindrical collar engaged in an opening in an upper wall of the casing, said collar having a central guide passage for the push rod and said collar including an annular groove and a plurality of re-entrant elements located on a peripheral portion of said collar, a plurality of retaining elements engaged perpendicularly with the main direction in a side opening in the casing and in the annular groove in order to prevent translation of the head along the main direction, a screw for fixing the head in rotation, said screw co-operating with one of said re-entrant elements in order to rotationally lock the head.

2. A safety switch according to claim 1 wherein the screw passes through an opening provided in a cover of a compartment of the casing which houses the contact assembly wherein said screw fixes the cover to the casing.

3. A safety switch according to claim 1, wherein at least one of the retaining elements comprises first and second side branches.

4. A safety switch according to claim 1, wherein the control head comprises an upper part forming a support for the control mechanism, and a hood fixed to the support by a fixing element accessible outside the casing.

5. A safety switch according to claim 1, which comprises at least one resilient indexing element provided between the control head and a wall of the opening of the casing in order to co-operate with the re-entrant elements.

* * * * *